US009428970B2

(12) United States Patent
Gustafsson et al.

(10) Patent No.: US 9,428,970 B2
(45) Date of Patent: Aug. 30, 2016

(54) DEVICE AND METHOD FOR HANDLING DRILL STRING COMPONENTS, AS WELL AS ROCK DRILLING RIG

(75) Inventors: Anders Gustafsson, Saltsjö-Duvnäs (SE); Olof Göransson, Sollentuna (SE); Lars Gellerhed, Enebyberg (SE)

(73) Assignee: Atlas Copco Craelius AB, Marsta (SE)

( * ) Notice: Subject to any disclaimer, the term of this patent is extended or adjusted under 35 U.S.C. 154(b) by 364 days.

(21) Appl. No.: 13/261,680

(22) PCT Filed: Nov. 30, 2011

(86) PCT No.: PCT/SE2011/051452

§ 371 (c)(1),
(2), (4) Date: Aug. 26, 2013

(87) PCT Pub. No.: WO2012/091657

PCT Pub. Date: Jul. 5, 2012

(65) Prior Publication Data

US 2013/0327541 A1 Dec. 12, 2013

(30) Foreign Application Priority Data

Dec. 30, 2010 (SE) ..... 1001245

(51) Int. Cl.
*E21B 19/15* (2006.01)
*E21B 19/20* (2006.01)

(52) U.S. Cl.
CPC ..... *E21B 19/15* (2013.01); *E21B 19/155* (2013.01); *E21B 19/20* (2013.01)

(58) Field of Classification Search
USPC ..... 166/380, 77.1, 85.1
See application file for complete search history.

(56) References Cited

U.S. PATENT DOCUMENTS

| | | | | |
|---|---|---|---|---|
| 3,888,318 | A | 6/1975 | Brown | |
| 3,919,902 | A | 11/1975 | Johnson | |
| 3,986,619 | A | 10/1976 | Woolslayer et al. | |
| 4,226,447 | A | 10/1980 | Brown | |
| 4,449,592 | A * | 5/1984 | Mayer | 175/52 |
| 4,822,230 | A | 4/1989 | Slettedal | |
| 5,794,723 | A | 8/1998 | Caneer, Jr. et al. | |
| 2003/0167623 | A1 | 9/2003 | Lorenz | |

FOREIGN PATENT DOCUMENTS

| | | |
|---|---|---|
| WO | WO 93/15303 | 8/1993 |
| WO | WO 2004/101417 | 11/2004 |
| WO | WO 2005/073497 | 8/2005 |

* cited by examiner

*Primary Examiner* — Taras P Bemko
(74) *Attorney, Agent, or Firm* — Mark P. Stone

(57) ABSTRACT

A handling device for handling drill string components (8, 8',8") in a rock drilling rig (1), wherein the handling device includes a gripper unit (11) for gripping drill string components (8, 8',8") to be put into and be brought out from the rock drilling rig, and wherein the gripper unit (11) includes grippers (12,13,14) operational for gripping components positioned in a gripping position, which defines a grip position axis (G). The gripper unit (11) is supported swingable between: a) a first position, wherein the gripper unit is positioned for engagement with an end portion of a first drill string component (8') and an end portion of a second drill string component (8") in and aligned with said active drill string position (A), and b) a second position, wherein a gripper unit (11) is positioned for engagement with an end portion of a drill string component in a delivering position for drill string components that are to be brought into respectively taken away from said active drill string position (A). The invention also concerns a rock drilling rig and a method.

20 Claims, 5 Drawing Sheets

DEVICE AND METHOD FOR HANDLING DRILL STRING COMPONENTS, AS WELL AS ROCK DRILLING RIG

FIELD OF THE INVENTION

The invention concerns a handling device for handling drill string components in a rock drilling rig according to the preamble of claim 1. The invention also concerns a corresponding method and a rock drilling rig equipped such a handling device.

BACKGROUND OF THE INVENTION

Core drilling for exploration purposes are usually preformed with rock drilling rigs where drill string components are positioned in the active drill string position, are lifted up and lowered down into the drill hole with the aid of a winch. The winch wire is attached to the uppermost drill string component with the aid of a lifting plug. Since core drilling aims at collecting a drilled-out core of rock to be investigated, it is the question about tubular drill string components. When the drill string is lifted up, which occurs frequently in order to exchange drill bits, the tubular string is lifted up unit by unit, whereby the single pipes are separated from each other with the aid of the rotator device of the rock drilling rig in co-operation with a lower pipe holder.

Final loosening of a pipe to be taken away from the tubular string is at present preformed by hand by the operators, wherein this handling includes final screwing apart, lifting and guiding of the pipe to the area of a pipe magazine.

During lowering of the drill string, the work operations are reversed so that new drill string components in the form of pipes are successively lifted to a position where they are aligned with the drill string and threaded together by the operator. These work operations are straining for the operator and results in a risk of lift and crash injuries to the operator that cannot be neglected.

Core drilling is often preformed to great depths, such as for example with drill lengths between one and two kilometers. Because of the wear that the drill bit is subjected to, it has to be exchanged relatively often, which results in that the entire drill string has to be picked up from the drill hole, be mounted apart into drill string components, the worn drill bit be taken away and be replaced with a new one, whereupon the drill string can again be lowered down into the hole. Thereupon a further distance is drilled until the drill bit has to be exchanged again etc. During the drilling, a flush water swivel is connected to the upper end of the drill string for providing flushing fluid for transporting away drill cuttings that have been removed through drilling.

AIM AND MOST IMPORTANT FEATURES OF THE INVENTION

It is an aim of the invention to provide a device of the above mentioned kind, wherein the problems according to the above are addressed and are at least partly solved. This is achieved in respect of a handling device according to the above through the features of the characterizing portion of claim 1.

Through the gripper unit being able to swing, it is allowed that in the first position it is arranged to actively align end portions of drill string components that are to be joined to each other. Hereby is achieved a possibility of adequate alignment as a whole between the drill string components to be joined and to be separated, which is a great advantage since it secures adequate handling of drill string components during screwing operations while avoiding thread damages, which can result from erroneous screwing attempts. It is also important that separation is carried out in alignment and in a controlled manner.

Through the ability to swing to the second position it is achieved that the gripper unit in this second position will be capable of engaging with an end portion of a drill string component in the delivering position in this position in a corresponding manner to provide alignment prior to screwing in and screwing out of a lifting plug or a flush water swivel (in case of the presently last drill string component of the drill string) in or from the gripped drill string component. The gripper unit thus has a further important function that has to do with attachment of a lifting plug and a water swivel respectively on the drill string component in the delivering position.

The gripper unit is preferably able to swing in a plane which most preferably is in parallel with the drill string axis in the rig.

In a preferred aspect, the gripper unit includes rotation means in order in said first as well as said second position to rotate at least any one of the components from the group: a second drill string component, a lifting plug, a flush water swivel. Herby the tightening function is integrated in a preferred manner with the alignment function for both the positions for screwing together and screwing apart the respective component with/from the also gripped (first) drill string component.

The rotation means are most preferably comprised of a rotation grip unit for simultaneous gripping and rotating of any one of: said end portion of the second drill string component, said lifting plug, said flush water swivel.

Preferably the operation of the rotation means is torque controlled for all screwing, so that erroneous attempts to screw together can be interrupted before any damages has been caused to the threads. This can be realised through a torque guard being arranged to monitor rotation under a few (for example 2-4) turns, during which, at normal impeccable screwing, otherwise a known low up to moderate torque level prevails. In case of torque increase above a determine level in the course of screwing a determined angle (for example 2×360°-4×360°) the attempt to screw together is interrupted and a new attempt will be made after resetting. A simple torque guard can in a per se known manner for example be comprised of a hydraulic torque guard being associated with the rotator means. Also other solutions can, however, be contemplated.

It is preferred that the gripper unit is provided with a first set of grippers for gripping said end portion of the first drill string component and the second set of grippers in order, together with the rotation grip unit, to allow gripping of any one of: said end portion of the second string component, said lifting plug, said flush water swivel.

These grippers are suitably manoeuvred in a sequence or separately, which gives flexibility to the device. Hereby preferably the gripper unit is arranged with a second set of grippers in order in the second position, to grip and align at least any one of: said lifting plug, said flush water swivel—with said end portion of a drill string component.

When, in a preferred embodiment, the gripper unit is provided with means for displacing said rotation means and preferably also the other set of grippers in parallel to said grip position axis in respect of the first set of grippers, it is achieved in a simple manner to achieve thread pitch compensation during screwing operation. This can be arranged by said rotation means and the second set of grippers being positioned on a common carrier which is displaceable in a controlled manner.

It is preferred that said rotation means and the first set of grippers and the second set of grippers are manoeuvrable to swing and in particular to the position of setting free the grip position more than 180°, as seen crosswise to the grip position axis. This way the grippers and said rotation means can be brought aside so far that they are not in the way during the swinging of the gripper unit.

According to a preferred aspect, the gripper unit is arranged on a swing unit, which is arranged to be fastened swingable on a carrier from at least one of the following: the rock drilling rig, a drill string transporter, a drill string magazine, a separate stand. It is preferred hereby that the gripper unit is arranged fastened swingable to the rock drilling rig and in particular to the feed beam above and in connection with a lower position of the rotator device.

Corresponding advantages are achieved in a rock drilling rig including a handling device according to the above and in respect of an inventive method.

The invention will now be described by way of embodiments and with reference to the annexed drawings.

DESCRIPTION OF EMBODIMENTS

Figure 1:
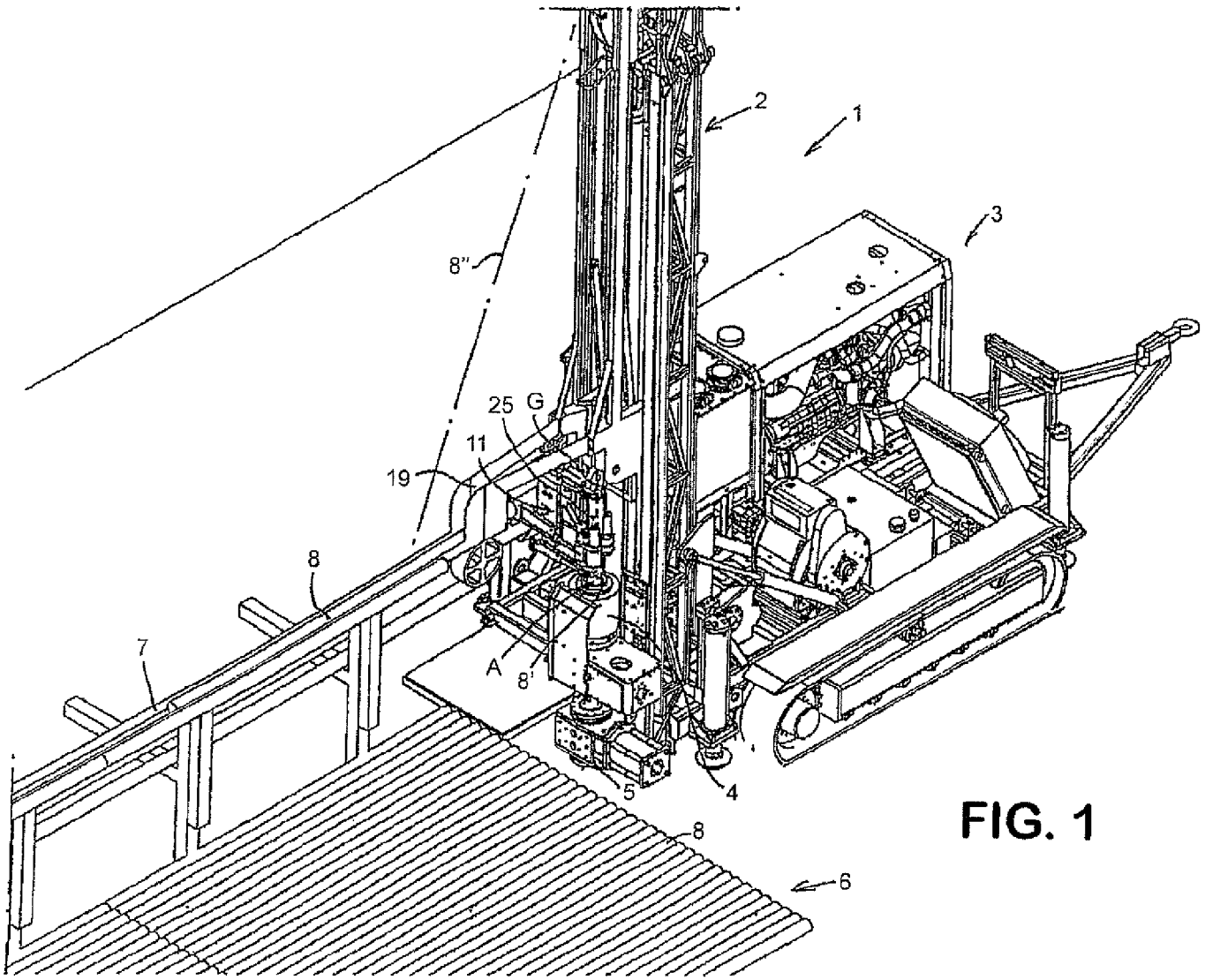
FIG. 1 shows an perspective view of a rock drilling rig for core drilling being provided with a handling device according to the invention and in connection with a magazine for drill string components.

In FIG. 1 is shown a rock drilling rig 1 for core drilling including a vertically positioned feed beam 2 whereon there is supported a to and fro moveable rotator device 4. Below (in the figure) the rotator device 4 is arranged a pipe holder 5 for temporal holding of the drill string when this is required.

Beside the feed beam 2 of the rock drilling rig 1 a power and supply aggregate 3 is arranged for providing pressure fluid etc. to the rock drilling rig 1, a lift winch (not shown) and a magazine 6 for receiving drill string components 8, which are to be delivered to and picked out from the rock drilling rig 1 in a manner which will be described below.

The magazine 6 can be formed in different ways but are in FIG. 1 exemplified in the form of a generally horizontal table, which is tiltable such that drill string components 8 can be brought to roll against a stand of a transporter 7. A lifting device (not shown) is arranged adjacent to the stand, said lifting device being arranged to lift a drill string component 8 being in a position closest to the transporter 7 on the magazine 6 up to an upper part of a transport band belonging to the transporter 7 for bringing the thus up-lifted drill string component in the direction towards the rock drilling rig.

In FIG. 1 is further indicated with a point-interrupted line at 8" a drill string component in a position during a lifting phase, which is an oblique position in respect of the feed beam 2.

This line at 8" in FIG. 1 is intended to illustrate an intermediate position during the lifting phase which is ended with the drill string component taking a position which is coaxial with an active drill string position of the rock drilling rig 1. Lifting will be achieved with the aid of a lifting plug (25 see below) being screwed-in uppermost on the drill string component 8". The lifting plug is during this process in turn connected to a (not shown) lifting wire, which in turn goes above a wire wheel (not shown) uppermost on the feed beam and with its second part extends essentially in parallel to the feed beam 2 to the lifting winch (not shown) being arranged in the area of the power and supply aggregate 3.

Furthermore, FIG. 1 shows a lifting plug 25 being gripped by a gripper unit 11 and threaded to an end portion of a first drill string component 8'.

On FIG. 1 is further shown that said end portion is protruding up from the rotator device 4 such that this first drill string component 8' is in an active drill string position A. The drill string component 8' exhibits a female thread for engagement with a corresponding male thread on the plug 25.

Joining together of a further, second, drill string component 8" to the first drill string component 8' for the purpose of lengthening the drill string for subsequent lowering into the drill hole is essentially according to the corresponding method for screwing on a lifting plug. See below.

The gripper unit 11 is shown in a first position in FIG. 1, wherein one gripping position being defined by the gripper unit 11, which exhibits a grip position axis G (see interrupted line in FIG. 1), is coaxial with said active drill string position A.

Further, it is shown more in detail in this figure a fastening structure 19, which is arranged to position the transporter 7 in respect of the rock drilling rig.

Figure 2:
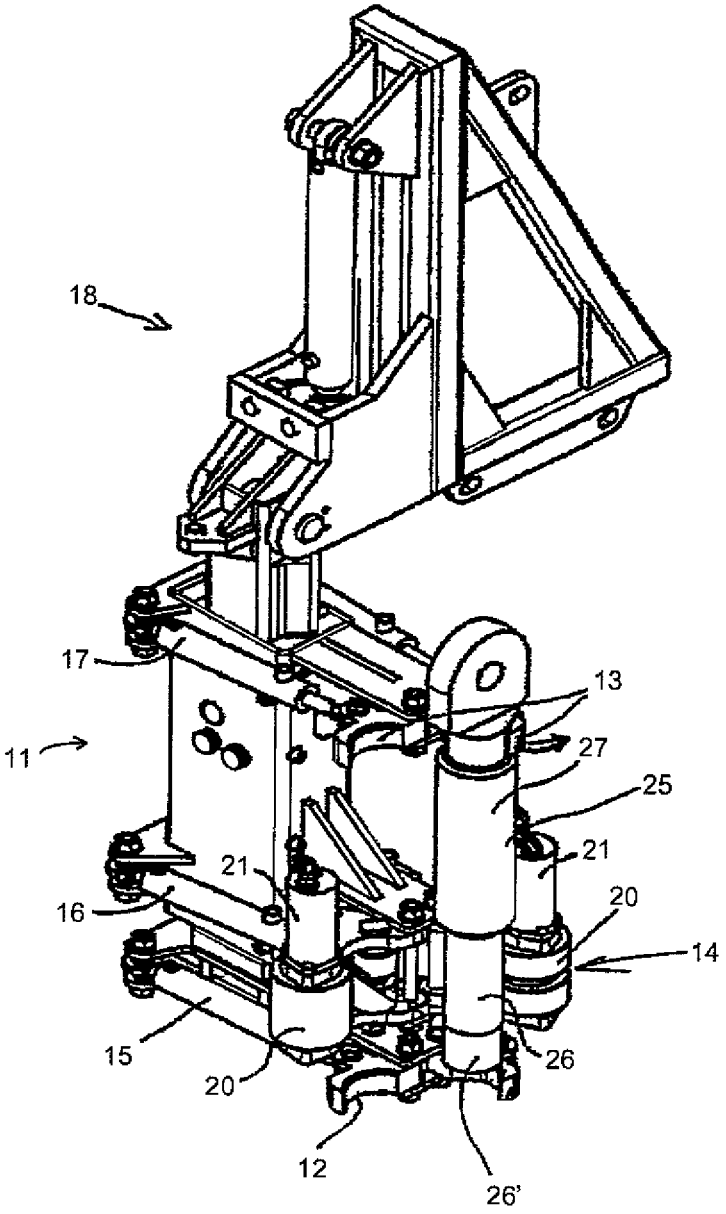
FIG. 2 shows a perspective view of the gripper unit being isolated and in a greater scale.

The gripper unit 11 which is shown in greater detail in FIG. 2, exhibits a first set of grippers 12 for the engagement with said first drill string component 8' (in FIG. 1) and rotation means 14 in the form of a rotation grip unit 14, which is equipped with drive rollers 20 for engagement with a component such as a drill string component to be rotated, and drive motors 21 for these drive rollers. Further, the gripper unit 11 has a second set of grippers 13 for the co-operation with the rotation grip unit 14 for engagement with a component.

The first set of grippers 12 are manoeuvred by hydraulic cylinders whereof one is indicated with 15 and the second set of, grippers are manoeuvred by hydraulic cylinders 17.

The rotation means 14 with the drive rollers are supported on swingable rotation clamping means which are brought to engagement with a component to be rotated with the aid of hydraulic cylinders whereof one is shown and is indicated with 16.

One part of the gripper unit 11 including the rotation means 14 and normally also the second set of grippers 13 is also displaceable in a position in parallel to said grip position axis G. The purpose of this ability to be displaced is to provide part of the gripping unit 11 and in particular the rotation means 14 with an axial movement and a rotation of a drive rolls, such that it is compensated for thread pitch during rotation of driving of the component to be rotated.

On FIG. 2 is further shown a swing unit 18, which is attached to the rig and supports gripper unit 11 for swinging between the position shown in FIGS. 1 and 2 and a swung down position, which is described below.

In FIG. 2 the set of grippers 12 and 13 are shown with the one respective grip hook open. In general it is true that open second set of grippers and swing in rotation means 14 to engagement with a plug or the drill string component allows rotation of the plug or the drill string component 8" without obstruction from engagement with a second set of grippers 13.

After positioning of a further drill string component to a position above one being present in position A (instead of the lifting plug 25 in FIG. 1), the drill string components are thus drawn together by the rotation means, whereupon the joint is as usual subjected to final tensioning by the rotator device 4. Thereupon the drill string can be lowered by giving slack to the lift wire.

Thereupon the drill string is lowered down to a position that is shown in FIG. 1, where the next drill string components has reached the position indicated with 8' with an end portion extending up from the rotator device 4 and with a lifting plug 25 attached above this drill string component. This lifting plug is now to be separated from the drill string.

The lifting plug 25 is comprised of a swivel device and exhibits for that purpose two mutually rotatable parts, which can be seen in FIG. 2, that is an engagement portion 26, which lowermost is provided with a male thread 26' at its free end which is directed against the drill string component and a lifting portion 27, which outermost is provided with a lifting eye for the co-operation with a lifting wire as is described above.

The rotation grip unit comprising the rotation means of the gripper unit 11 includes the drive rollers 20, which exhibits a surface having engagement means for ensuring a good grip engagement against the component to be rotated. The drive motors 21 are in the shown example arranged sideways from the drive rollers 20 and are carried on a swing arm construction carrying the rotation means 14 together therewith.

When the gripper unit 11 is activated such that the rotation means 14 and the second set of grippers 13 are displaced axially in a direction from the drill string component 8, the drive rollers 20 are rotated for rotational driving of the engagement portion 26. The lifting plug 25 is brought axially in the direction from the drill string component it is intended to be pulled free from. The lifting portion 27 is simultaneously held by said second set of grippers 13 for preventing rotation thereof and for preventing unwanted rotation to propagate to the lifting wire.

The first set of grippers 12 has thus gripped the end portion of the drill string component 8' whereas the rotation means 14 have come to an engagement with the engagement portion of the lifting, plug 25 and the second set of grippers 13 have come into an engagement with the lifting portion 27 of the lifting plug 25, whereupon loosening of the lifting plug 25 is achieved through rotational action of a rotation means 14.

When the lifting plug 25 is drawn free from the drill string component 8' (FIG. 1) it is swung by means of the swing unit 18, which carries the gripper unit 11 from the first position in the direction of said second position. In order to allow this swing action, the first set of grippers 12 have opened whereas the rotation means 14 as well as the second set of grippers 13 are still in engagement with the lifting plug 25.

Figure 3:
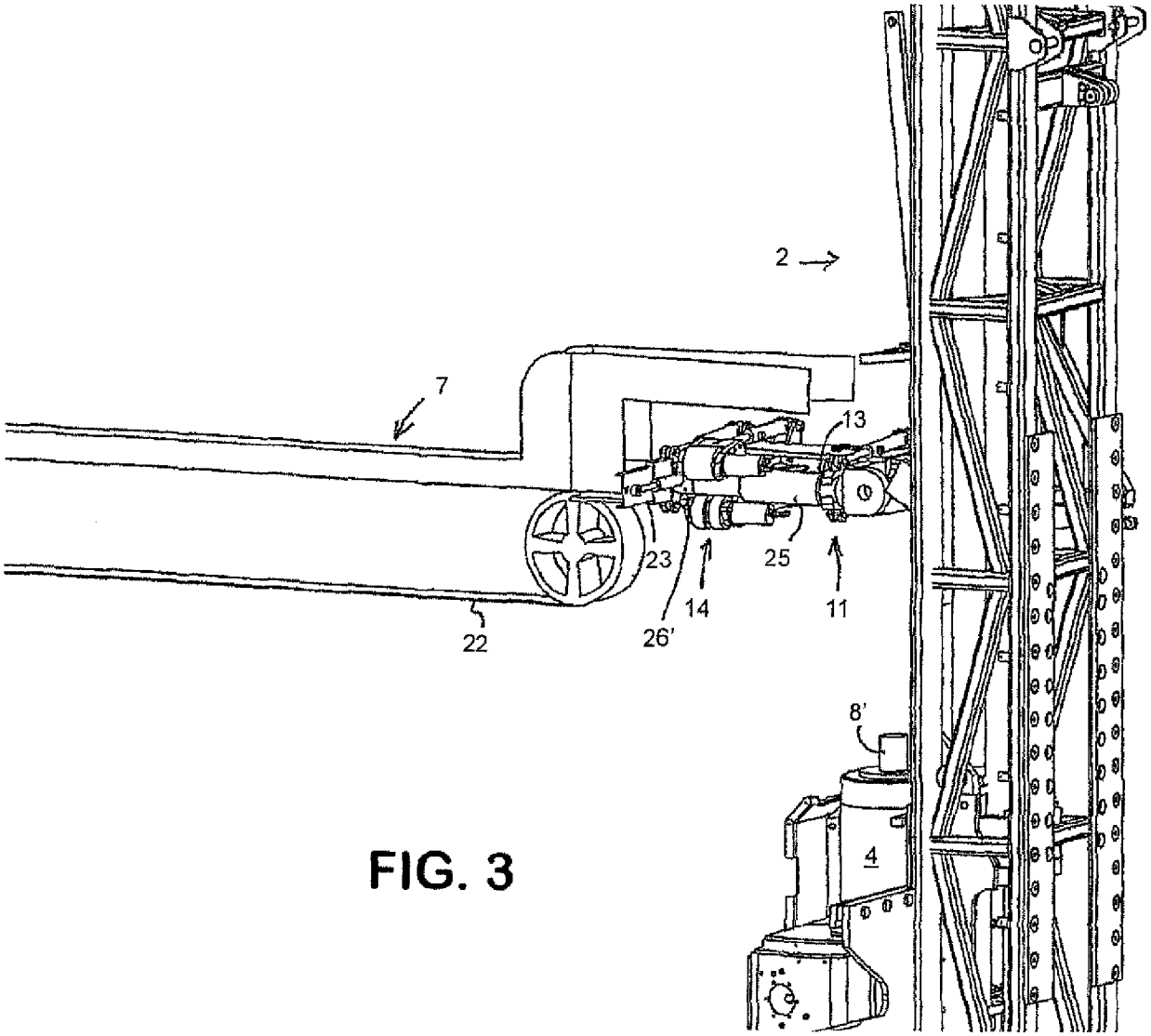
FIGS. 3-5 shows in perspective views details of the handling device in connection with a rock drilling rig.

From FIG. 3 is clear that said swing unit has swung the gripper unit 11 holding the lifting plug 25 to a position where the grip position is essentially horizontal for the co-operation with drill string components lying on the transporter 7 which is connected to said magazine.

Figure 4:
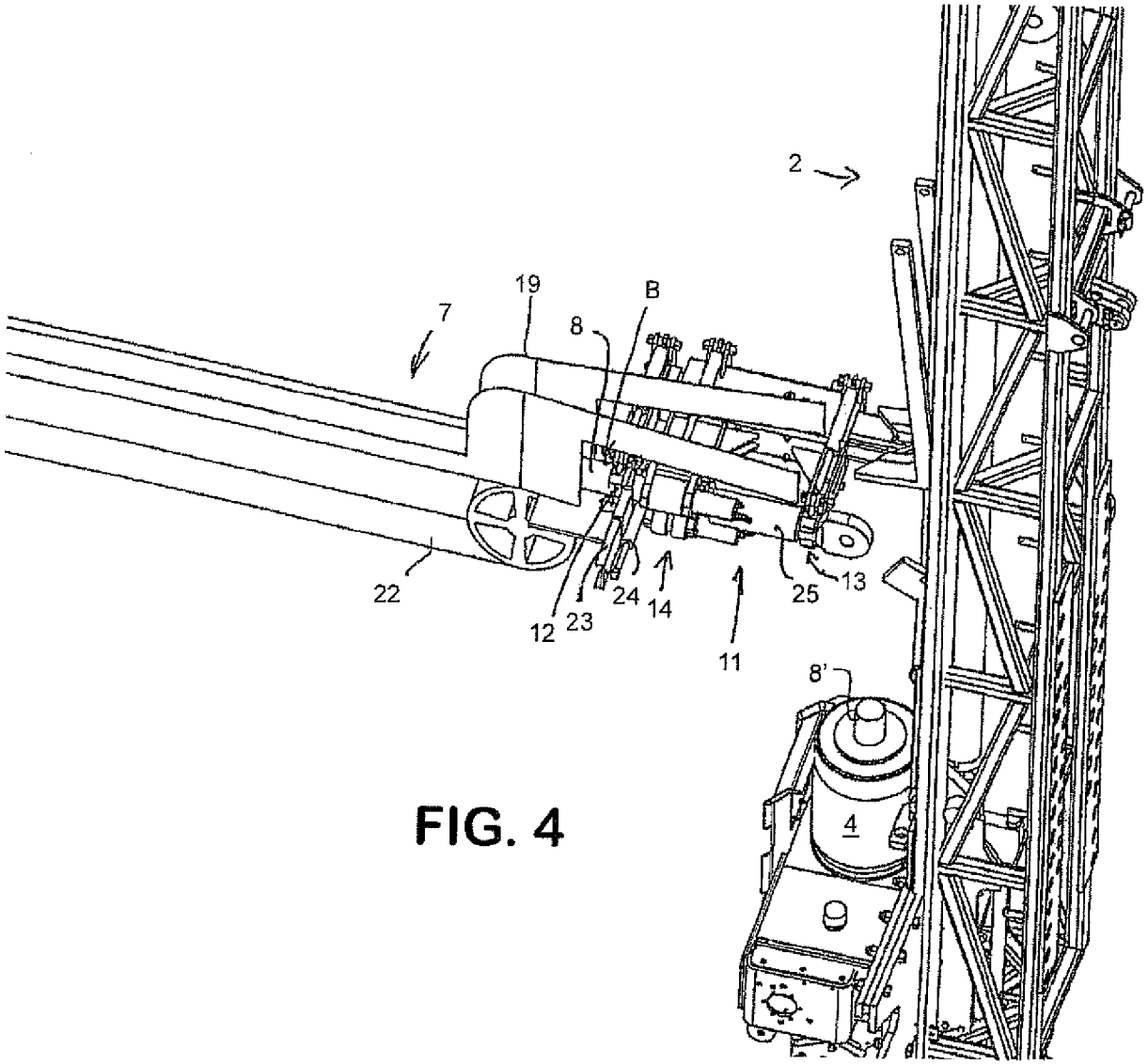

In the position shown in FIG. 4, a drill string component 8 has been brought forward on the transporter 7 against a stop element 23 which can be brought forward and back, and which is actuated by a hydraulic cylinder 24. The transporter 7 is provided with a transport band 22 which is driven by transporter wheels for bringing drill string components 8 to and from a delivering position B for drill string components, which is the position being defined by said stop 23 and which comprises a determined position for the drill string component.

This determined position can be ensured in other ways, for example by drivers on the transporter which are arranged to stop in determined positions.

On FIG. 4 is shown the first set of grippers 12 in a position for gripping engagements with the drill string component 8, which has reached said position and after said stop 23 having been brought to the side so as to free the end of the drill string component 8 such that a female thread positioned outermost on the drill string component 8 now being in the determined position becomes accessible.

The lifting plug 25 is held by the rotation grip unit 14 which comprises the rotation means and the second set of grippers 13 and is now ready for being threaded together with a drill string component 8.

After completed screw thread joining, the drill string component 8 can be drawn up from the transporter to the rock drilling rig by means of the lifting winch, such that it can be placed in the active drill string position A in FIG. 1.

For the purpose of compensation for thread pitch during screwing, a unit including the rotation means comprising the rotation grip unit 14 and the second set of grippers 13 also in this case to be displaced axially in the direction towards the drill string component 8 and the drive rollers are rotated.

After completed screwing of the male thread 26' on the engagement portion 26 into the female thread in the drill string component 8, the first set of grippers 12 are again opened as well as the rotation means 14 and the second set of grippers 13. Hereby the drill string component 8 is free to be lifted by the lift wire so that it i.a. passes the position shown with point-interrupted line on FIG. 1 and subsequently ending in the position for the second drill string component along "the grip position axis" indicated with G in FIG. 1.

Thereupon it can be screwed together with a drill string as is described above at the background of that figure.

So far the operative function of the handling device according to the invention has been described for lowering a drill string after for example exchange of a drill bit. With taking up of the drill string, in principle the opposite procedure is followed, namely screwing of the lifting plug on a drill string component sitting in the active drill string position, pulling up of the lifting plug with attached drill string to a position where the rotator device in a per se known manner is arranged to pull free the upmost drill string component from following drill string components.

Thereupon a additional lifting occurs of the drill strings such that the next drill string component with its end portion ends up in the position which is illustrated in FIGS. 1 and 4, whereupon the gripper unit 11 is actuated and with the rotation means 14 grips the uppermost drill string component and with a first set of grippers 12 grips the next drill string component ("the first") for the purpose of alignment in connection with that the rotation means 14 are driven for controlled screw loosening this drill string component.

Thereupon the thus loosened drill string component is brought from the position in parallel with the active drill string position with its lower end, so that it ends up on the transport band on the transporter 7, whereupon that is driven at the same time as the lifting wire is slacked so that the drill string component ends up lying on said transport band.

Figure 5:
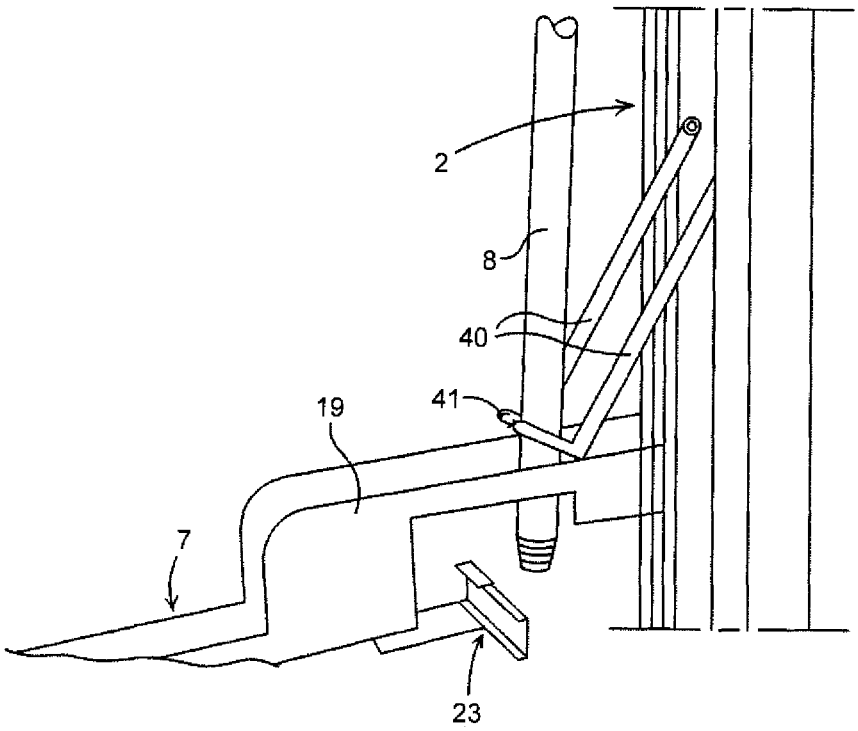

For assisting when bringing out the lower end of the drill string component to a position on said transport band or the like there is arranged a swingable and power driven support arm 40 with fork-shaped engagement portion 41 for guiding engagement with a drill string component (see FIG. 5), said support arm having the double function on the one hand to function as driving ejector in order to bring out the pipe end to a transporter, a roller carriage or the like, on the other hand as the function of a guiding introducer in order to guide-in the drill string component prior to screwing it on to the drill string at the end of the lifting movement which is described above.

Figure 6:
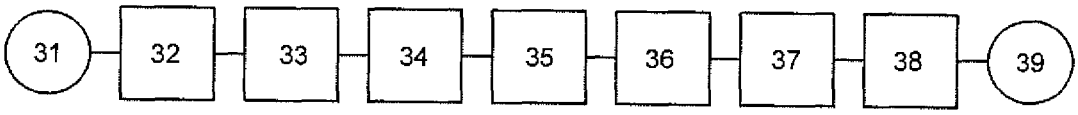
FIG. 6 shows diagrammatically a flow chart of a method according to the invention.

In FIG. 6 is diagrammatically illustrated a method sequence including a method according to the invention concerning taking up a drill string in a rock drilling rig, for example for exchange of drill bit, wherein:

Position 31 indicates start of the sequence.

Position 32 indicates pulling up of the drill string to an uppermost position and ensuring that the rotator device is in its lowermost position after having drawn free the uppermost drill string component from the next drill string component.

Position 33 indicates swinging-in the entire gripper unit to the first position.

Position 34 indicates activating the first set of grippers for gripping an end portion of the lowest drill string component (8' in FIG. 1) and of the rotation grip unit for gripping an end portion of the uppermost drill string component (8" indicated in FIG. 1).

Position 35 indicates loosening of the uppermost drill string component through the rotation grip unit and thereafter opening of all grippers of the gripper unit.

Position 36 indicates removing the free drill string component and placing it in a delivering position.

Position 37 indicates swinging the gripper unit to the second position and gripping the lifting plug and the end portion of the freed drill string component for loosening of the lifting plug through the rotation grip unit.

Position 38 indicates swinging of the gripper unit to the first position for tightening the lifting plug on to the end portion of the now uppermost drill string component.

Position 39 indicates the end of the sequence.

This sequence is intended to be repeated as many times as necessary. When it is instead about lowering a drill string, for example after drill bit exchange, the steps are generally performed in the opposite order, which has been described in detail at the background of the figures.

The invention has been described at the background of rock drilling rig for core drilling, but it is adaptable also for other types of rigs such as for oil drilling and the like. The invention can be modified within the definition of the claims. It is preferred that the gripper unit integrates the above described functions, but it is within the scope of the invention that the gripper can be constructed otherwise and that the second set of grippers are replaced by the rotation unit. It is not excluded that the rotation unit is comprised of a device arranged beside the gripper unit which engages the components to be rotated. The swing movement of the gripper unit can be made differently and it can be attached to some other component than the feed beam of the rig itself.

It is preferred that the gripper unit is provided with said first set of grippers for gripping said end portion of the first drill string component. It is, however, not excluded that the first set of grippers are exchanged to a guiding alignment device without gripper function such as for example a fork shaped element. This element may, when it is brought forward, perform the required adequate alignment of the gripper unit in respect of the drill string component in question by such element having guiding means such as fork shanks that are allowed to come into guiding engagement with an end portion of the drill string component in question.

The invention claimed is:

1. A handling device for handling drill string components in a rock drilling rig, including a rotator device, which is arranged for rotation and driving a drill string and is moveable to and fro, supported by a feed beam, wherein the handling device includes a gripper unit for gripping drill string components that are to be put into and be brought out from an active drill string position of the rock drilling rig, and wherein the gripper unit includes grippers operational for gripping components positioned in a gripping position, which defines a grip position axis, wherein the gripper unit is supported swingable in a plane which is in parallel with the drill string axis in the rig between:

a) a first position corresponding to said active drill string position, wherein the gripper unit is positioned for engagement with an end portion of a first of said drill string components and an end portion of a second of said drill string components and, wherein the gripper unit is aligned with the drill string in said active drill string position, and b) a second position corresponding to a delivering position, wherein the gripper unit is positioned for engagement with an end portion of one said drill string component in said delivering position for said drill string components that are to be brought into, or respectively, taken away from said active drill string position, said gripper unit including at least two sets of grippers, one of said set of grippers provided for gripping said first drill string component in said first position, and another of said set of grippers provided for gripping said second drill string component in said first position.

2. The handling device according to claim 1, wherein the gripper unit includes rotation means, for rotating, in said first as well as said second position, at least one of the components from the group: a second drill string component, a lifting plug, a flush water swivel—for screwing together and screwing apart this component with and from a gripped first drill string component.

3. The handling device according to claim 2, wherein the rotation means are comprised of a rotation grip unit for simultaneous gripping and rotating any one of: said end portion of the second drill string component, said lifting plug, said flush water swivel.

4. The handling device according to claim 3, wherein the gripper unit is provided with a first set of grippers for gripping said end portion of the first drill string component and a second set of grippers for allowing gripping, together with the rotation grip unit, of any one of: said end portion of the second drill string component, said lifting plug, said flush water swivel.

5. The handling device according to claim 4, wherein the gripper unit is provided with means for displacing said rotation means in parallel with said grip position axis in respect of the first set of grippers.

6. The handling device according to claim 5, wherein said rotation means, the first set of grippers and the second set of grippers are maneuverable to swing.

7. The handling device according to claim 4, wherein said rotation means, the first set of grippers and the second set of grippers are maneuverable to swing.

8. The handling device according to claim 7, wherein said rotation means, the first set of grippers and the second set of grippers are maneuverable to swing to positions for freeing the grip position over 180° as seen crosswise to the grip position axis.

9. The handling device according to claim 1, wherein the gripper unit is arranged on a swing unit, which is arranged to be fastened swingable on a support from at least one of: the rock drilling rig, a drill string transporter, a drill string magazine, a separate stand.

10. A rock drilling rig including a rotator device for rotation and driving a drill string and being movable to and fro supported by a feed beam, wherein said rock drilling rig includes the handling device according to claim 1.

11. A method for handling drill string components in a rock drilling rig, which includes a rotator device, which is arranged for rotation and driving a drill string and is moveable to and fro, supported by a feed beam, wherein drill string components that are to be put into and be brought out from an active drill string position of the rock drilling rig, are gripped by a gripper unit with grippers operational for gripping components positioned in a gripping position, which defines a grip position axis, wherein the steps of said method include:

swinging the gripper unit in a plane which is in parallel with the drill string axis in the rig between:

a) a first position corresponding to said active drill string position, wherein the gripper unit is capable of engaging an end portion of a first of said drill string components and an end portion of a second of said drill string components and, wherein the gripper unit is aligned with the drill string in said active drill string position, and b) a second position corresponding to a delivering position, wherein the gripper unit is capable of engaging an end portion of one said drill string component in said delivering position for said drill string components that are to be brought into, or respectively, taken away from said active drill string position, and providing the gripper unit with at least two sets of grippers, one of said set of grippers provided for gripping the first drill string component in the first position, and another of said set of grippers provided for gripping the second drill string component in the first position.

12. The method according to claim 11, wherein in said first as well as in said second position, at least one of the components from the group: a second drill string component, a lifting plug, a flush water swivel—are rotated means on the gripper unit for screwing together and screwing apart this component with and from the likewise gripped first drill string component.

13. The method according to claim 12, wherein said end portion of the first drill string component is gripped by a first set of grippers on the gripper unit and said end portion of the second drill string component is gripped by said rotation grip unit, or by said rotation grip unit and a second set of grippers of the gripper unit, in said first position.

14. The method according to claim 13, wherein the gripper unit is arranged with said rotation means together with the second set of grippers, in the second position, to grip and align at least one of: said lifting plug, said flush water swivel—with said end portion of a drill string component.

15. The method according to claim 14, wherein said rotation means is moved in parallel with said grip position axis in respect of the first set of grippers with the aid of means being arranged on the gripper unit.

16. The method according to claim 15, wherein said rotation means, the first set of grippers and the second set of gripper are swinging to positions for freeing the grip position over 180° as seen crosswise to the grip position axis.

17. The method according to claim 14, wherein said rotation means, the first set of grippers and the second set of gripper are swinging to positions for freeing the grip position over 180° as seen crosswise to the grip position axis.

18. The method according to claim 13, wherein said rotation means is moved in parallel with said grip position axis in respect of the first set of grippers with the aid of means being arranged on the gripper unit.

19. The method according to claim 18, wherein said rotation means, the first set of grippers and the second set of gripper are swinging to positions for freeing the grip position over 180° as seen crosswise to the grip position axis.

20. The method according to claim 13, wherein said rotation means, the first set of grippers and the second set of gripper are swinging to positions for freeing the grip position over 180° as seen crosswise to the grip position axis.

* * * * *